US007104838B1

(12) United States Patent
Northey

(10) Patent No.: US 7,104,838 B1
(45) Date of Patent: Sep. 12, 2006

(54) ELECTRICAL CONNECTOR ATTACHMENT

(75) Inventor: William Arthur Northey, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/074,464

(22) Filed: Mar. 7, 2005

(51) Int. Cl.
*H01R 13/73* (2006.01)

(52) U.S. Cl. ..... 439/566; 439/84

(58) Field of Classification Search ..... 439/566, 439/571, 570, 564, 83, 567, 607, 560, 572, 439/84

See application file for complete search history.

(56) References Cited

U.S. PATENT DOCUMENTS

| | | | | |
|---|---|---|---|---|
| 2,947,964 A | | 8/1960 | Johanson et al. | 339/17 |
| 3,403,369 A | | 9/1968 | Steiff et al. | 339/17 |
| 3,553,635 A | | 1/1971 | Lungergan et al. | 339/258 |
| 4,299,436 A | | 11/1981 | Ackerman | 339/258 R |
| 4,433,886 A | * | 2/1984 | Cassarly et al. | 439/571 |
| 4,512,618 A | * | 4/1985 | Kumar | 439/95 |
| 4,627,157 A | * | 12/1986 | Campisi et al. | 29/741 |
| 4,978,307 A | | 12/1990 | Billman et al. | 439/83 |
| 5,064,379 A | | 11/1991 | Ryll et al. | 439/81 |
| 5,228,861 A | | 7/1993 | Grabbe | 439/66 |
| 5,443,391 A | * | 8/1995 | Maeda et al. | 439/84 |
| 5,462,454 A | * | 10/1995 | Kramer et al. | 439/571 |
| 5,700,159 A | * | 12/1997 | Albeck | 439/571 |
| 5,860,831 A | | 1/1999 | Roder et al. | 439/422 |
| 6,080,012 A | * | 6/2000 | Zhu et al. | 439/567 |
| 6,106,332 A | * | 8/2000 | Souisa | 439/571 |
| 6,193,567 B1 | | 2/2001 | Hsieh | 439/853 |
| 6,280,246 B1 | * | 8/2001 | Sawayanagi | 439/567 |
| 6,280,248 B1 | * | 8/2001 | Mitra | 439/571 |
| 6,511,336 B1 | | 1/2003 | Turek et al. | 439/249 |
| 6,764,325 B1 | * | 7/2004 | Arrigotti et al. | 439/161 |

FOREIGN PATENT DOCUMENTS

WO WO-2005/008837 A1 1/2005

* cited by examiner

*Primary Examiner*—Tulsidas C. Patel
*Assistant Examiner*—Phuongchi Nguyen
(74) *Attorney, Agent, or Firm*—Harrington & Smith, LLP

(57) ABSTRACT

An electrical connector including a housing; electrical contacts connected to the housing; and a shield connected to the housing. The shield includes connection sections which are adapted to extend through holes in a substrate and be deformed to fixedly and stationarily mount the shield and the housing to the substrate. A spring can be provided between the shield and the substrate.

20 Claims, 3 Drawing Sheets

ELECTRICAL CONNECTOR ATTACHMENT

BACKGROUND OF THE INVENTION

1. Field of the Invention

The present invention relates to an electrical connector and, more particularly, to attachment of an electrical connector to another member.

2. Brief Description of Prior Developments

Electrical connectors are sometimes provided with a shield, such as an exterior ground shell, to shield the electrical contacts of the connector from effects such as electromagnetic interference (EMI) for example. It is known to mount electrical connectors to printed circuit boards with the contacts of the connectors having through-hole press fit tails or surface mounted tails, and a ground shield/shell of the connector having tails which are through-hole press fit connected to the printed circuit board.

It is also known to extend tails of electrical contacts through a substrate and then bend the tails to help retain the contacts on the substrate.

There is a desire to provide an electrical connector which has a greater resistance to disconnection from a printed circuit board than conventional through-hole press fit connected connectors. There is also a desire to provide an electrical connector which is biased against the substrate it is connected to, such that there is less risk of damage to electrical connections between contacts of the electrical connector and conductors of the substrate. There is also a desire to provide an enhanced mechanical connection of an electrical connector to a substrate by use of a shield of the electrical connector.

SUMMARY OF THE INVENTION

In accordance with one aspect of the present invention, an electrical connector is provided including a housing; electrical contacts connected to the housing; and a shield connected to the housing. The shield includes connection sections which are adapted to extend through holes in a substrate and be deformed to fixedly and stationarily mount the shield and the housing to the substrate. A spring can be provided between the shield and the substrate.

In accordance with another aspect of the present invention, a printed circuit board assembly is provided comprising a printed circuit board; and an electrical connector connected to the printed circuit board. The electrical connector comprises a shield with connection sections extending through the printed circuit board from a first side of the printed circuit board past a second side of the printed circuit board and deformed back toward the second side of the printed circuit board. First portions of the connection sections on the second side of the printed circuit board are spring biased towards the second side of the printed circuit board. Second portions of the connection sections are in tension between the first portions and the rest of the shield.

In accordance with one method of the present invention, a method of connecting an electrical connector to a substrate is provided comprising inserting connection sections of a shield of the electrical connector through holes in the substrate from a first side of the substrate and out a second side of the substrate; and deforming ends of the connection sections at the second side of the substrate back towards the second side of the substrate. The ends of the connection sections are spring biased in a direction towards the second side of the substrate to spring biased portions of the electrical connector towards the first side of the substrate.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
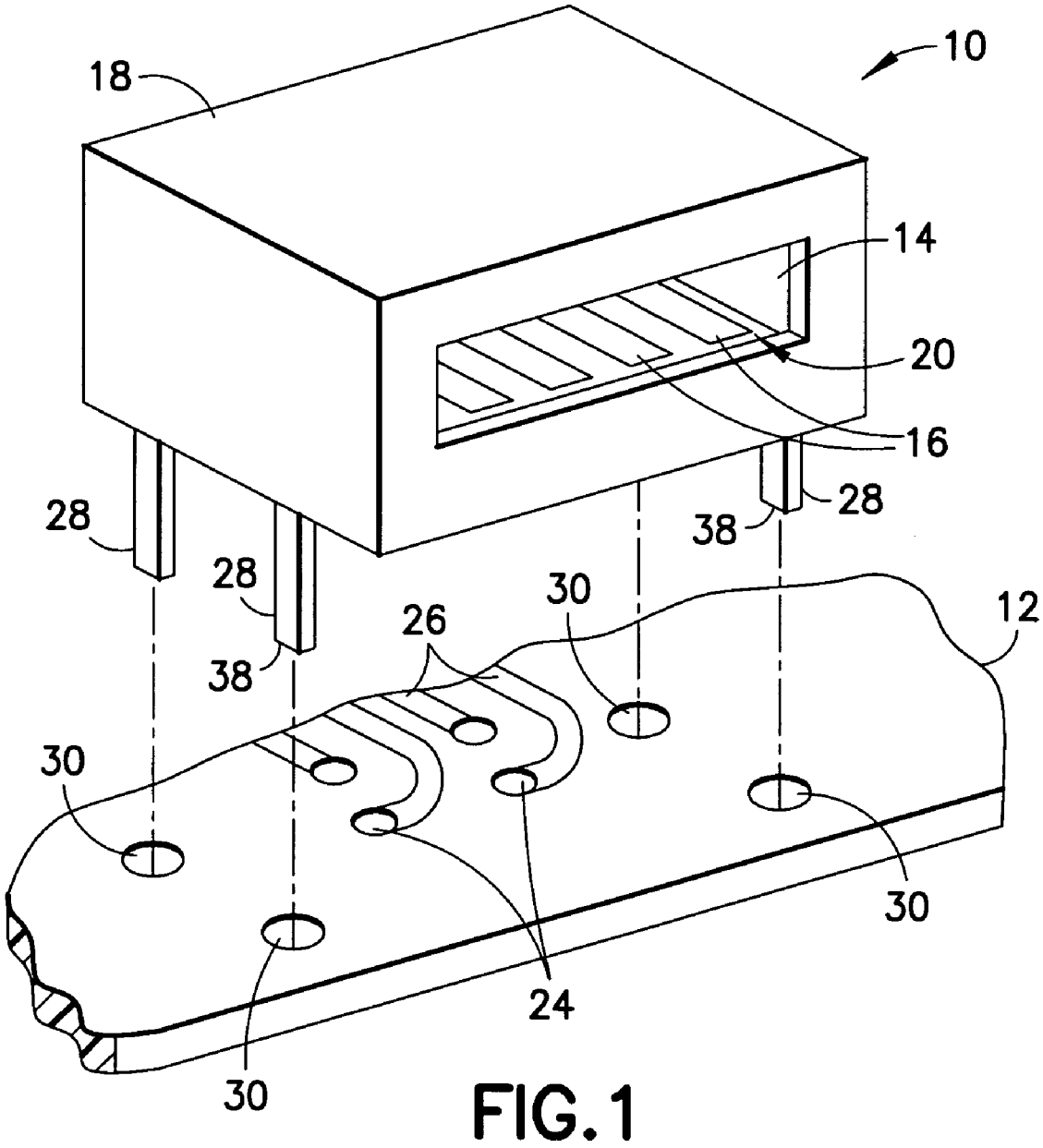
FIG. 1 is a perspective view of an electrical connector incorporating features of the present invention and a printed circuit board.

Referring to FIG. 1, there is shown a perspective view of an electrical connector 10 incorporating features of the present invention. The connector 10 is adapted to be connected to another member, such as printed circuit board 12 for example, to form an electronic assembly 13 (see FIG. 2). Although the present invention will be described with reference to the exemplary embodiments shown in the drawings, it should be understood that the present invention can be embodied in many alternate forms of embodiments. In addition, any suitable size, shape or type of elements or materials could be used.

The electrical connector 10 generally comprises a housing 14, electrical contacts 16 connected to the housing, and a shield 18. The housing 14 is comprised of a dielectric material, such as a molded plastic or polymer material. In this embodiment, the housing 14 forms a receiving area 20 for receiving a mating male electrical connector (not shown). However, in alternate embodiments, any suitably sized or shaped housing could be provided. The electrical contacts 16 extends into the receiving area 20 for connection with the male electrical connector (not shown). In this embodiment, the electrical contacts 16 comprise spring contacts. Ends of the electrical contacts 16 extend from the bottom side of the housing 14.

Figure 2:
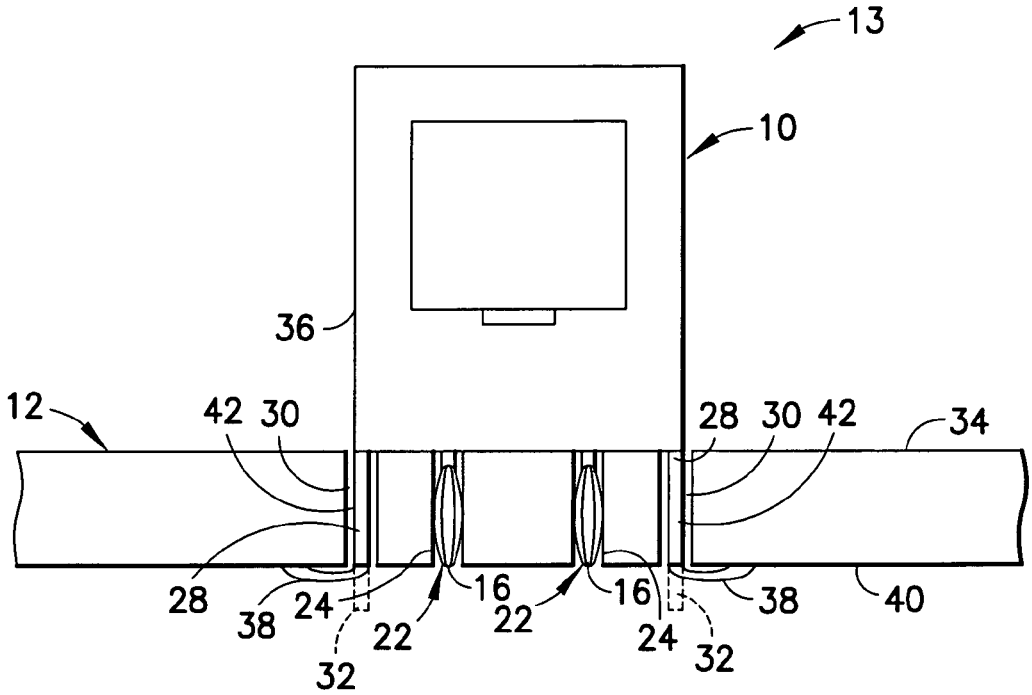
FIG. 2 is a diagram showing connection of the electrical connector shown in FIG. 1 to the printed circuit board.

Referring also to FIG. 2, in the embodiment shown, the ends of the electrical contacts 16 comprise press fit contact tails 22 which are adapted to be press fit into apertures 24 of the printed circuit board 12. The printed circuit board 12 comprises conductors 26 which extend into the apertures 24. Thus, when the contact tails 22 are inserted into the apertures 24 the tails 22 make electrical contact with the conductors 26 and a mechanical connection with the printed circuit board 12. In an alternate embodiment, any suitable type of electrical contacts could be provided including, for example, contacts having surface mount contact tails. In addition, although features of the present invention are being described with reference to a printed circuit board, the present invention could be used with any suitable type of substrate or electronic assembly which the electrical connector is attached to.

The shield 18 is connected to the housing 14. Shield 18 comprises connection sections 28. The shield 18 is preferably comprised of metal. In a preferred embodiment, the shield 18 forms a metal shell which surrounds a majority of the housing 14. The connection sections 28 are adapted to extend through holes 30 in the printed circuit board 12. Before connection of the electrical connector 10 to the printed circuit board 12, the connection sections 28 are substantially straight. During manufacture of the assembly 13, the connection sections 28 are inserted through the holes 30 as shown by dotted lines 32 in FIG. 2.

A majority of the electrical connector 10, including most of the shield 18, is located against a first side 34 of the printed circuit board 12. The connection sections 28, on the other hand, extend from the main section 36 of the shield 18 located on the first side 34, through the holes 30, and have ends 38 which extend past a second side 40 of the printed circuit board 12. The ends 38 of the connection sections 28 are then deformed into a general stapled configuration or shape as shown in FIG. 2. More specifically, the ends 38 are deformed to extend generally back towards the shield 18 and against the second side 40 to form a general stapled connection of the shield 18 with the printed circuit board 12. In the embodiment shown, the ends 38 are stapled in an outward direction. However, in alternate embodiments, the ends 38 could be stapled in an inward direction or any other suitable direction(s), so long as the ends 38 extend back towards the second side 40 of the printed circuit board 12. This stapled connection provides a substantially fixed and stationarily mount of the shield, and the housing contained within the shield, to the printed circuit board 12.

When the stapled connection is made a portion 42 of each connection section 28 is subjected to a tensile force. This occurs because the main section 36 of the shield 18 is loaded against the first side 34 of the printed circuit board and the ends 38 of the connection sections 28 are loaded against the opposite second side 40 of the printed circuit board.

One feature of the present invention is the ability of the stapled connection to form a slight spring connection of the shield 18 with the printed circuit board 12. More specifically, because of the slightly cantilevered shape of the ends 38, the ends 38 can be spring loaded against the second side 40. Thus, a portion of the connection sections 28 form a small spring; similar to a leaf spring. However, in an alternate embodiment, a spring feature might not be provided. In addition, the stapled connection (by use of connection sections 28 on the shield 18 to attach the electrical connector 10 to the printed circuit board 12) provides an increased tolerance feature. This allows the precise size of the connection sections 28 to have an increased manufacturing tolerance and readily adjust to printed circuit board manufacturing tolerance thicknesses. This is becoming increasingly important as the sizes of electrical connectors and printed circuit boards, or other substrates, are being reduced in newer electronic assemblies.

This invention describes a method for mechanically securing a connector body of a press fit terminated connector to a circuit board. Securing the connector mechanically has advantages when the connector has some mechanical latching means (not shown) that could cause failure of the circuit board termination with the electrical contacts if the latch mechanism is pulled. Such forces could cause the press fit termination of the contacts 16 at tails 22 to move, thus causing the terminals to shift in the plated through holes 24 that the connector tails 22 are pressed into. In severe cases in the prior art, the connector could be pulled from the board. The disclosed method and connector allows for an alternative means to soldering the connector in place, as done in the prior art, while achieving good strain relief to the circuit board.

One idea here is to attach a connector to a substrate by stapling or twisting tails of the connector to an opposite surface of the substrate. Both surface mount and press-fit connectors can be used with this invention.

Figure 3:
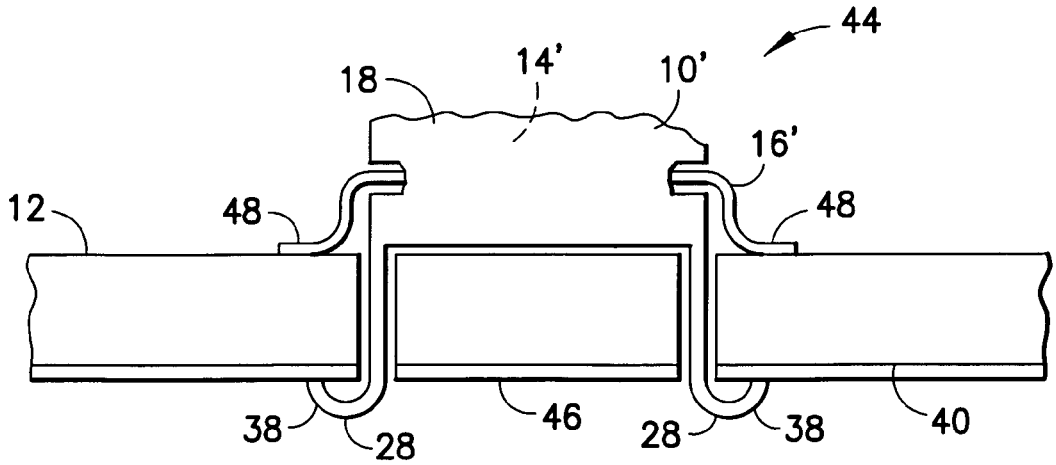
FIG. 3 is a diagram showing an alternate embodiment of the present invention.

Referring now also to FIG. 3, a system is shown to keep the connection sections or tabs 28 bent in tension. The assembly 44 in this embodiment comprises the printed circuit board 12, an electrical connector 10', and a spring member 46. The electrical connector 10' comprises a housing 14', the shield 18 and electrical contacts 16'. The electrical contacts 16' comprise surface mount solder tails 48.

The spring member 46 comprises a flexible member, such as a elastomeric metal or plastic sheet for example. The spring member 46 is located against the bottom side 40 of the printed circuit board 12. When the ends 38 of the connection sections 28 are stapled, the ends 38 can contact the spring member 46. The spring member 46 provides a spring function between the bottom of the printed circuit board and the top of the ends 38 of the connection sections 28.

Figure 4:
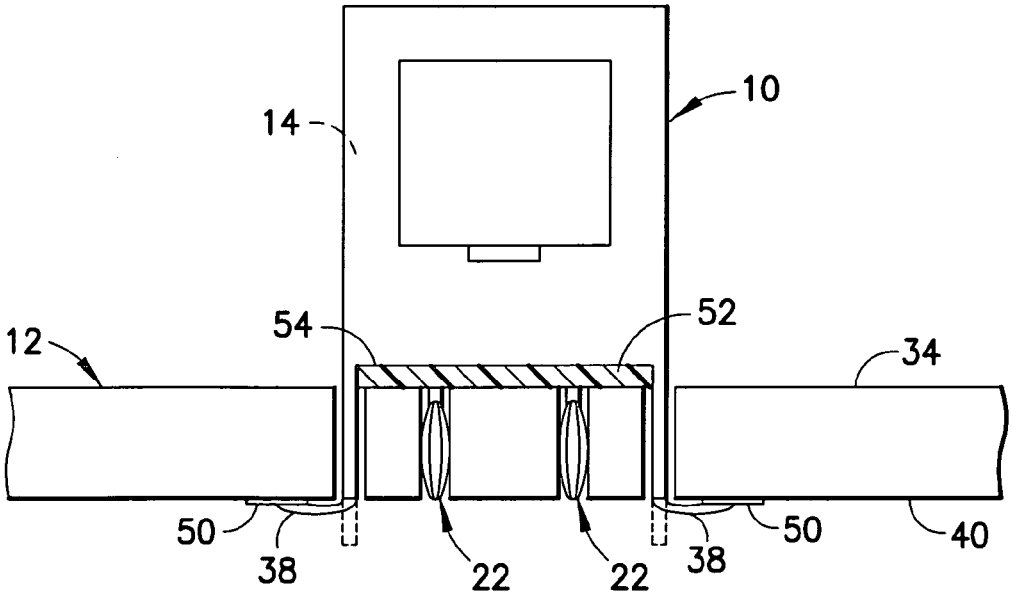
FIG. 4 is a diagram showing another alternate embodiment of the present invention.

Referring to FIG. 4, another alternate embodiment is shown. In this embodiment the ends 38 of the connections sections 28 can be attached to contact pads 50 located on the underside 40 of the substrate 12. The body of the connector can have a flexible member 52 on the mounting side (bottom) of the connector located against the top side 34 of the substrate 12, between the top surface 34 of the board and the bottom 54 of connector housing 14, to provide a spring force that pushes the connector housing 14 and shield 18 away from the top surface 34 of the substrate. This will keep the tabs 38 in tension against the bottom 40 of the substrate; against the contact pads 50. One example of the spring member could be an elastomeric metal or plastic seal, or some sort of spring legs attached to the connector housing or main section of the shield.

Figure 5:
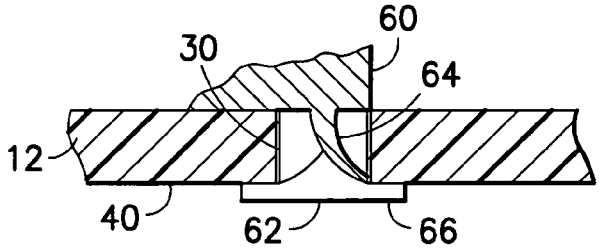
FIG. 5 is a partial cross sectional view of another alternate embodiment of the present invention.

As mentioned above, the attachment of the shell to the substrate could comprise a twist. Referring to FIG. 5, one embodiment of a twist connection is shown. In this embodiment the shell 60 has a connection section 62. The connection section 62 has a section 64 which extends through the hole 30 in the printed circuit board 12. The connection section 62 also has a section 66 located past the second side 40 of the printed circuit board 12. The second section 66 is turned after passage through the hole 30 to twist the first section 64 located in the hole 30. This causes the section 66 to press against the side 40 to fixedly clamp portions of the board 12 between the second section 66 and the rest of the shell 60. In alternate embodiments, any suitable twist could be provided, or a combination of twist and staple could be provided.

Figure 6:
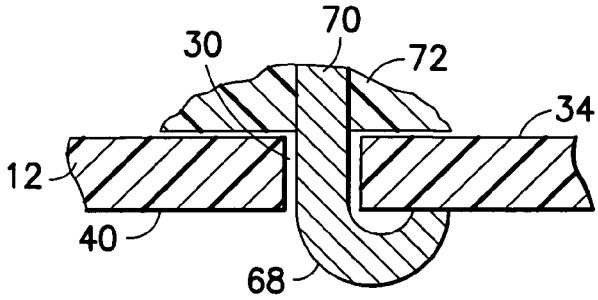
FIG. 6 is a cross sectional view of another alternate embodiment of the present invention.

Referring also to FIG. 6 another alternate embodiment is shown. In this embodiment the connection section 68 is not part of the shell. Instead, the connection section 68 is part of another member 70 which is attached to the housing 72. The connection section 68 extends through the hole 30 and is stapled against the side 40 to attach the housing 72 firmly against the side 34 of the board 12.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing;

electrical contacts connected to the housing; and a connection section that extends from the housing, the connection section adapted to extend through holes in a substrate and be deformed to fixedly and stationarily mount the housing to the substrate, wherein the connection section comprises tails which are adapted to be inserted into the holes without substantial resilient deflection and subsequently deformed into a general stapled shape, wherein the tails are adapted to extend from a first side of the substrate, past a second side of the substrate, and deformed substantially into a U shape back toward the second side of the substrate.

2. An electrical connector as in claim 1 further comprising a metal shell, wherein the connection section is attached to the metal shell.

3. An electrical connector as in claim 1 wherein the electrical contacts comprise press fit contact tails.

4. An electrical connector as in claim 1 wherein the electrical contacts comprise surface mount contact tails.

5. An electrical connector as in claim 1 wherein the connection sections comprise a spring section.

6. An electrical connector as in claim 1 further comprising a shield at least partially surrounding the housing, wherein the connection section is integrally formed with the shield.

7. An electronic assembly comprising:

a substrate comprising electrical conductors; and an electrical connector as in claim 6 fixedly attached to the substrate, wherein the electrical contacts are connected to the electrical conductors, and wherein the connection sections extend through the substrate and are deformed with ends of the connection sections extending generally back towards the shield to form a general stapled connection of the shield with the substrate.

8. An electronic assembly as in claim 7 further comprising a resilient member located between the ends of the connection sections and the substrate.

9. An electronic assembly comprising:

a substrate comprising electrical conductors; and an electrical connector fixedly attached to the substrate, wherein the electrical connector comprises a housing;

electrical contacts connected to the housing; and a shield on a majority of the housing, wherein the shield comprises a connection section that extends from the housing, wherein the connection section is adapted to extend through holes in the substrate without substantial resilient deflection and be deformed to fixedly and stationarily mount the housing to the substrate, wherein the electrical contacts are connected to the electrical conductors, and wherein the connection section extends through the substrate and is deformed with ends of the connection section extending generally back towards the shield to form a general stapled connection of the shield with the substrate without a soldered connection of the ends to the substrate, and wherein the connection section forms a spring located between the substrate and at least one portion of the shield.

10. A printed circuit board assembly comprising:

a printed circuit board; and an electrical connector connected the printed circuit board, wherein the electrical connector comprises a shield with connection sections extended without substantial resilient deflection through the printed circuit board from a first side of the printed circuit board past a second side of the printed circuit board and deformed back toward the second side of the printed circuit board, wherein first portions of the connection sections on the second side of the printed circuit board are spring loaded with the second side of the printed circuit board without a soldered connection of the connection sections to the second side of the printed circuit board, and wherein second portions of the connection sections are in tension between the first portions and the rest of the shield.

11. A printed circuit board assembly as in claim 10 wherein the shield comprises a metal shell which surrounds a majority of the housing.

12. A printed circuit board assembly as in claim 10 wherein the connection sections comprise tails which are deformed into a general stapled shape.

13. A printed circuit board assembly as in claim 10 wherein the connection sections comprise a spring section.

14. A printed circuit board assembly as in claim 10 further comprising a spring located between the substrate and at least one portion of the shield.

15. A printed circuit board assembly as in claim 10 wherein the connection sections extend through the substrate and are deformed with ends of the connection sections extending generally back towards the shield to form a general stapled connection of the shield with the substrate.

16. A printed circuit board assembly as in claim 15 further comprising a resilient member located between the ends of the connection sections and the substrate.

17. A method of connecting an electrical connector to a substrate comprising:

inserting substantially straight connection sections of a shield of the electrical connector without substantial resilient deflection through holes in the substrate from a first side the substrate and out a second side of the substrate; and deforming ends of the connection sections at the second side of the substrate back towards the second side of the substrate, wherein the ends of the connection sections are spring loaded with the second side of the substrate without a soldered connection of the ends to the second side of the substrate, to spring biased portions of the electrical connector towards the first side of the substrate.

18. A method as in claim 17 further comprising providing a spring between the ends of the connection sections and the second side of the substrate.

19. A method as in claim 17 further comprising providing a spring between the portions of the shield and the substrate.

20. An electrical connector comprising:

a housing;

at least one electrical contact connected to the housing; and a shield connected to the housing, wherein the shield comprises a connection section that extends from the housing and is adapted to extend through a hole in a substrate, wherein the connection section is adapted to be deformed to fixedly mount the shield to the substrate, wherein the connection section comprises a first section and a relatively larger second section at a distal end of the first section, and wherein the first section is adapted to be axially twisted by rotation of the second section to press the second section against the substrate.

* * * * *